United States Patent [19]

Robinson

[11] Patent Number: 4,557,385

[45] Date of Patent: Dec. 10, 1985

[54] BAG WITH EASY OPEN LINE OF PERFORATIONS

[75] Inventor: William M. Robinson, Chesterfield, Mo.

[73] Assignee: Union Camp Corporation, Wayne, N.J.

[21] Appl. No.: 582,948

[22] Filed: Feb. 23, 1984

[51] Int. Cl.[4] ..... B65D 33/36; B65D 33/18

[52] U.S. Cl. ..... 206/620; 206/610; 383/88

[58] Field of Search ..... 206/620, 610, 616, 618; 383/88; 229/17 G

[56] References Cited

U.S. PATENT DOCUMENTS

| | | | |
|---|---|---|---|
| 2,172,930 | 9/1939 | Bensel | 229/17 G |
| 2,527,074 | 10/1950 | Port | 206/620 |
| 2,634,896 | 4/1953 | Graveno | 229/17 G |
| 2,750,102 | 6/1956 | Thurman | 206/620 |
| 3,029,012 | 4/1962 | Leslie | 206/620 |
| 3,095,088 | 6/1963 | Blaikie et al. | 206/616 |
| 3,276,669 | 10/1966 | Vilutis | 206/616 |
| 3,663,239 | 5/1972 | Rowe et al. | 206/620 |
| 4,228,898 | 10/1980 | Zeitter et al. | 229/17 G |

*Primary Examiner*—Stephen P. Garbe

*Attorney, Agent, or Firm*—Kane, Dalsimer, Kane, Sullivan and Kurucz

[57] ABSTRACT

A gusseted bag having one end folded over along a fold line to form a closure for such end, which bag is provided with a line of perforations through the wall of the bag along a portion of one face and the adjacent gusset at or adjacent to the said fold line to provide easy access to the contents of the bag.

7 Claims, 5 Drawing Figures

BAG WITH EASY OPEN LINE OF PERFORATIONS

BACKGROUND OF THE INVENTION

1. Field of the Invention

The invention relates to gusseted bags which are closed by pasting or sewing at both ends, and more particularly to a bag provided with a line of perforations so that the bag can be easily torn open for access to the product in the bag.

2. Description of the Prior Art

The prior art does not disclose a bag having the same opening perforations as the bag of the present invention.

The common method of opening such bags is to insert a tear cord along a perforated tear line such as is shown in U.S. Pat. No. 3,958,749. However, such tear cord requires an extra operation for insertion into the bag and has other disadvantages such as catching on things which tear open the bag and the problem of gripping and pulling the cord.

Gabled top milk cartons with a line of perforations which permit the top closure to be torn off and the closure to be opened are shown in U.S. Pat. Nos. 2,137,614, 2,634,896 (U.S. Pat. No. Re. 24839) and U.S. Pat. No. 3,147,904.

SUMMARY OF THE INVENTION

The invention comprises a gusseted bag having one end folded over along a fold line to form a closure for such end which bag embodies an easy open improvement comprising:

a line of transverse perforations extending through the wall of the bag in one face and the adjacent gusset;

the said line of perforations being positioned just below the said fold line;

the said line of perforations extending across the said face from the adjacent gusset edge crease;

the first perforation of the said line of perforations in said one face being cut through the said gusset edge crease;

whereby a tear in the line of perforations can be started at the said edge crease and continue along the line of perforations to open the bag and provide easy access to the contents of the bag.

DETAILED DESCRIPTION OF THE PREFERRED EMBODIMENT OF THE INVENTION

Figure 1:
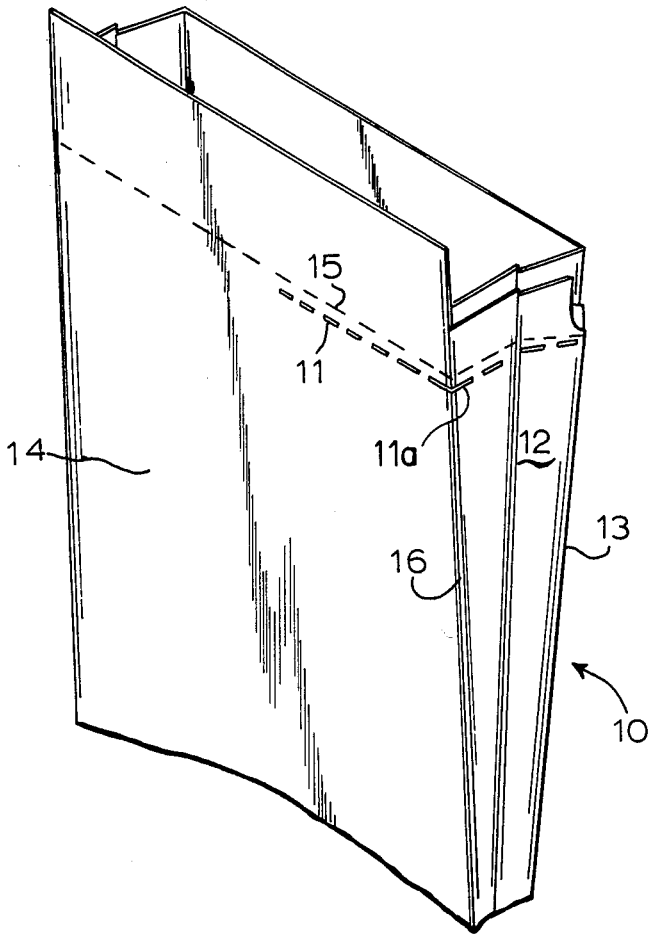
FIG. 1 is a perspective view of the open end of a pinch stepped end (pasted bottom open mouth) bag prior to closure of such end showing the line of perforations in the one face and in the gusset area.
Figure 2:
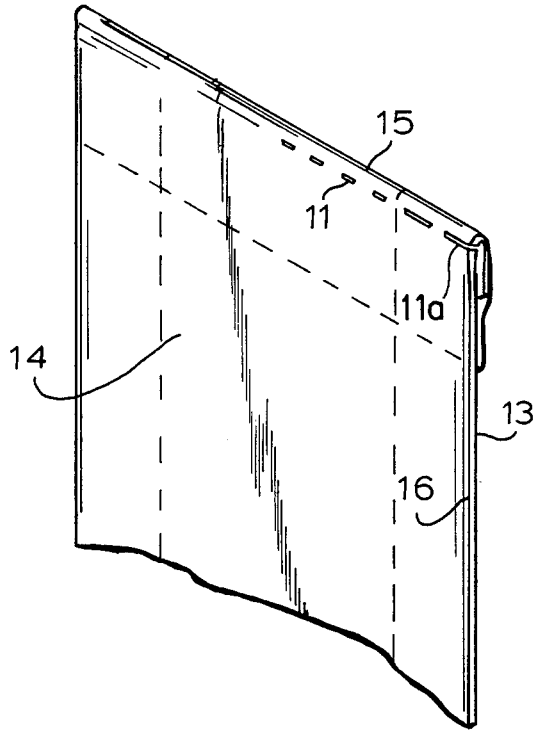
FIG. 2 is a perspective view of the end of the bag of FIG. 1 after such end has been closed and pasted.
Figure 3:
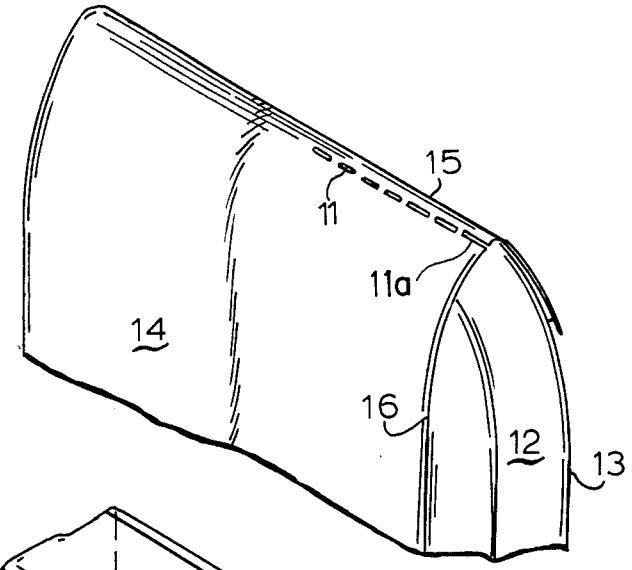
FIG. 3 is a perspective view of the end of the bag of FIG. 2 after the bag has been filled with the product and closed.
Figure 4:
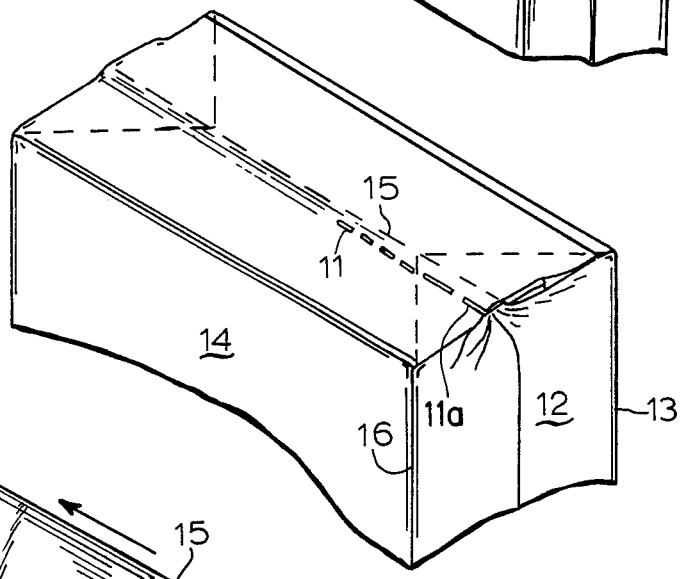
FIG. 4 is a perspective view of the end of the bag of FIG. 2 after the bag has been filled with the product, closed and squared out at the bottom.
Figure 5:
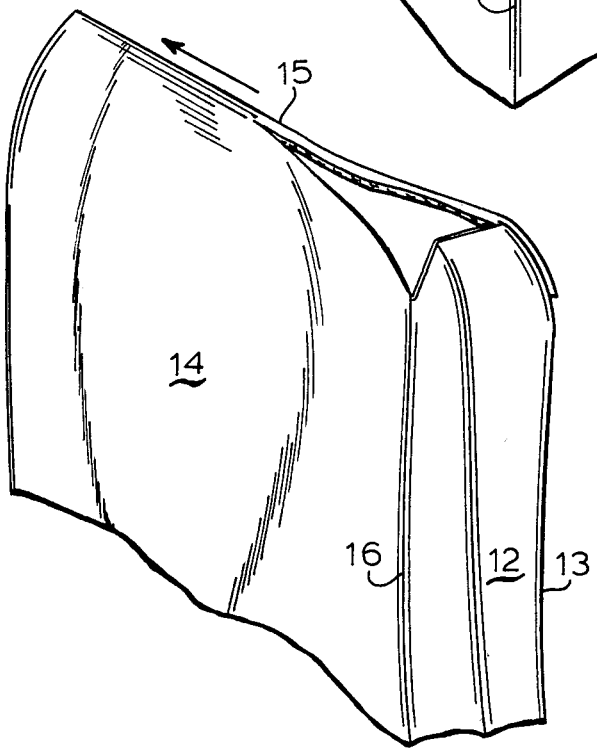
FIG. 5 is a perspective view of the bag of FIG. 3 after the bag has been torn along the line of perforations.

Referring to the drawings, there is shown in FIG. 1 a gusseted pasted bottom open mouth (PBOM) or pinch type bag 10. Such bags are well known and conventional for packaging products such as pet foods, fertilizer, animal meal, dry milk, similar food stuffs and a variety of other products. In packaging many of the products and in large size bags the wall would be formed of a plurality of plies. For pet foods such bag would generally include an inner ply which is usually of greaseproof paper or plastic film.

The bag of the present invention embodies a line 11 of horizontal or transverse perforations through all plies of the bag or through all but one ply (to prevent sifting or retain barrier ply integrity of said one ply). In the case of a multiply bag there would be a line of perforations in each ply (except the inner greaseproof or plastic ply in the case of pet food bags). Also in the case of a multiply bag with all paper plies any one of the paper plies could be left unperforated to add strength and prevent sifting. The line of perforations starts in one gusset 12 of the bag near the edge 13 of the back face (vertical seam side) and extends through the gusset area (both gusset panels and on around onto the front face 14 of the bag. The perforation line extends from about $\frac{1}{8}''$ up to the entire face width of the bag, depending on the size of the bag and the desired opening length. The perforation line can coincide with the fold line 15 of the closure, but it has been found preferable and advantageous to locate such line slightly below the fold line with the line of perforations in each ply of the bag positioned so that the lines of perforations are superimposed. The best position of the easy open perforation line is in the area from $\frac{1}{8}''$ from the fold line to no more than $\frac{1}{4}$ of the gusset width from the fold line. For bags with a 3" gusset this means the perforation line should be no more than $\frac{3}{4}''$ from the fold line and for a 6" gusset no more than $1\frac{1}{2}''$. If the line is on the fold line it will probably weaken the bag. If it is located more than $\frac{1}{4}$ of the gusset width from the fold line it will be difficult to use (or tear) in the manner designed. The difficulty of opening will become progressively worse as it gets further away from the fold line.

This easy open feature is designed so that a person can easily tear open the top or bottom of the bag (depending on which end of the bag the line of perforations are placed) by grasping near the top of the bag the back edge of the gusset tuck in one hand and the front edge of the gusset tuck in the other hand and, with the thumbs of both hands in the gusset tuck, spread the hands to force the perforated front edge of the gusset and the bag face to tear horizontally. Once the corner of the bag is torn open several inches as described above and a larger opening is desired the user can insert one hand into the opening and tear the remainder of the top of the bag open along the top fold line by pushing his hand along this line.

The key to the success of the feature is proper design of the perforations to provide easy starting of the tearing action but not making the perforations too long or extensive to cause bag failures in the filling, closing, or distribution cycle. It is important that the first perforation 11*a* at the bag edge 16 on the front gusset panel be cut through the edge crease. It is extremely difficult to start a tear along the folded edge of several plies of paper or other sheet material. However, a small cut on this edge with a continuing line of perforations makes it relatively easy to start the tear action and continue it for several inches.

The perforation or special cuts are longest at and near the edge 16 and then get shorter as they progress across the bag face 14. This is done to prevent excessive weakening of the bag toward the middle section where the gusset stresses occur during the bag handling. The larger or longer perforations at the edge of the bag do not pose a problem since there is very little stress in this area during bag handling.

It will be understood that this line of perforations for easy opening can be applied to other styles of gusseted bags, such as sewn open mouth, pasted square or sewn closures on automatics (SOS), etc.

Those skilled in the art will appreciate that variations and modifications of the above described embodiment of the invention may be made without departing from the spirit and scope of the invention.

What is claimed:

1. In a gusseted bag having a wall formed into a front face, a back face and a two panel gusset at each side of the bag connecting the faces along gusset edge creases and having an end which includes a fold line which extends transversely to said gusset edge creases, said end being adapted to be folded over along said fold line to form a closure for said end, an easy open improvement comprising:

a line of transverse perforations extending through the wall of the bag in at least one panel of one gusset and the one face connected to the said one panel of the said one gusset, the said line of perforations being positioned within an area extending from at least $\frac{1}{8}$" from the said fold line to no more than $\frac{1}{4}$ of the combined widths of the panels of the said one gusset from the fold line and parallel thereto;

the said line of perforations in the said one face extending in length at least $\frac{1}{8}$" from the one edge crease connecting the said one face and said one gusset;

the first perforation of the said line of perforations in said one face being cut through the said one edge crease;

whereby a tear in the line of perforations can be started at the said edge crease and continued along the line of perforations to open the bag and provide easy access to the contents of the bag.

2. The bag of claim 1 in which the wall of the bag comprises a plurality of plies and there is a line of perforations in each ply with the lines of the perforations of the plies positioned so that they are superimposed.

3. The bag of claim 1 in which the wall of the bag comprises a plurality of plies and there is a line of perforations in each ply, with the exception of the inner ply which is unperforated and serves as a barrier ply, with the lines of the perforations of the plies positioned so that they are superimposed.

4. The bag of claim 1 in which the wall of the bag comprises a plurality of plies and there is a line of perforations in each ply, with the exception of an intermediate ply which is unperforated and serves as a barrier ply, with the lines of the perforations of the plies positioned so that they are superimposed.

5. The bag of claim 1 in which the perforations are longest at and near the edge crease and get shorter as they progress across the bag face.

6. The bag of claim 1 in which the said line of perforations in the said one face extends in length from the said one edge crease at least one quarter of the width of the said one face.

7. The bag of claim 1 in which the said line of perforations in the said one face extends in length from the said one edge crease for the full width of the said one face.

* * * * *